US009075394B2

(12) United States Patent
Stranczl et al.

(10) Patent No.: US 9,075,394 B2
(45) Date of Patent: Jul. 7, 2015

(54) FLEXIBLE ESCAPEMENT MECHANISM WITH MOVABLE FRAME

(71) Applicant: NIVAROX-FAR S.A., Le Locle (CH)

(72) Inventors: Marc Stranczl, Nyon (CH); Thierry Hessler, St-Aubin (CH); Andres Cabezas Jurin, Yverdon (CH); Davide Sarchi, Renens (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 14/389,012

(22) PCT Filed: Mar. 27, 2013

(86) PCT No.: PCT/EP2013/056577

§ 371 (c)(1),
(2) Date: Sep. 29, 2014

(87) PCT Pub. No.: WO2013/144236

PCT Pub. Date: Oct. 3, 2013

(65) Prior Publication Data

US 2015/0063082 A1 Mar. 5, 2015

(30) Foreign Application Priority Data

Mar. 29, 2012 (EP) ..... 12162030

(51) Int. Cl.
*G04B 15/14* (2006.01)
*G04B 15/08* (2006.01)

(52) U.S. Cl.
CPC ..... *G04B 15/14* (2013.01); *G04B 15/08* (2013.01)

(58) Field of Classification Search
CPC ..... G04B 15/00; G04B 15/06; G04B 15/08; G04B 15/14
USPC ..... 368/124, 127, 132
See application file for complete search history.

(56) References Cited

U.S. PATENT DOCUMENTS

| | | | | |
|---|---|---|---|---|
| 2,531,273 | A * | 11/1950 | Philippe | 368/127 |
| 6,942,378 | B2 * | 9/2005 | Hayek et al. | 368/127 |
| 7,458,717 | B2 * | 12/2008 | Baumberger et al. | 368/127 |
| 7,963,693 | B2 * | 6/2011 | Genequand | 368/170 |
| 8,540,418 | B2 * | 9/2013 | Richard et al. | 368/128 |
| 2008/0219104 | A1 | 9/2008 | Jurin et al. | |
| 2011/0019506 | A1 | 1/2011 | Dehon | |
| 2013/0070570 | A1 | 3/2013 | Colpo et al. | |

FOREIGN PATENT DOCUMENTS

| | | |
|---|---|---|
| CH | 60813 | 7/1912 |
| EP | 1 967 919 | 9/2008 |

(Continued)

OTHER PUBLICATIONS

International Search Report Issued Jul. 8, 2013 in PCT/EP13/056577 Filed Mar. 27, 2013.

*Primary Examiner* — Vit W Miska
(74) *Attorney, Agent, or Firm* — Oblon, McClelland, Maier & Neustadt, L.L.P.

(57) ABSTRACT

An escapement mechanism for a timepiece movement or timepiece including at least one balance and at least one escape wheel. A transmission of impulses between the balance and the escape wheel is achieved by a single-piece flexible mechanism including at least one feeler spindle cooperating with the escape wheel or, respectively, with the balance, and the single-piece, flexible mechanism is connected by at least one flexible blade to a fixed structure of the timepiece, or respectively to the escape wheel.

12 Claims, 6 Drawing Sheets

(56) References Cited

FOREIGN PATENT DOCUMENTS

| | | |
|---|---|---|
| EP | 2 037 335 | 3/2009 |
| EP | 2 105 806 | 9/2009 |
| EP | 2 221 677 | 8/2010 |
| EP | 2 450 755 | 5/2012 |
| WO | 2011-120180 | 10/2011 |

* cited by examiner

FLEXIBLE ESCAPEMENT MECHANISM WITH MOVABLE FRAME

FIELD OF THE INVENTION

The invention concerns an escapement mechanism for timepiece movement or timepiece including at least one balance and at least one escape wheel.

The invention also concerns a timepiece movement including a fixed structure and at least one mechanism of this type.

The invention also concerns a timepiece including a fixed structure and at least one mechanism of this type, and/or at least one timepiece movement of this type.

The invention concerns the field of timepiece mechanisms, and more specifically escapement mechanisms.

BACKGROUND OF THE INVENTION

Watchmaking performance requires high precision movements, with minimum space requirements, and a reduced number of components, in order to control production, assembly and adjustment costs. LIGA or DRIE technologies can produce flexible, precise components, and challenge conventional architectures, which are characterized by a high number of components and complex adjustments.

WO Patent No 2011/120180 A1 in the name of Rolex SA discloses a pallet type brake lever, with two arms, each provided with a pallet-stone for engaging with the same toothed wheel, with two elastic arms connecting the brake lever to a frame which enables it to pivot, and a third elastic element substantially forming a bistable system.

EP Patent No 2037335 A2 in the name of Enzler & Von Gunten, discloses a single piece Swiss lever, with two arms each provided with a pallet-stone, and including arms formed by flexible blades connected to a structure and defining a false pivot.

EP Patent No 2450755 A1 in the name of Nivarox discloses an escape wheel for a timepiece mechanism, including a plurality of toothed wheels, which are coaxial and pivot synchronously about a pivot axis and include at least a first toothed impulse wheel in a first impulse plane and at least a second toothed release wheel in a second stopping plane, parallel to or merged with the first impulse plane. The second toothed release wheel includes at least one moveable assembly which includes, on the one hand, at least one release tooth that is moveable radially relative to the pivot axis and returned to a position of equilibrium by a first return means, and on the other hand, at least one locking tooth returned in a first radial direction towards a stop position by a second return means. The release tooth includes a drive means arranged, when the release tooth moves in a second radial direction opposite to the first radial direction, to cooperate with a complementary drive means comprised in the locking tooth in order to drive the locking tooth in the second radial direction. When the release tooth moves in the first radial direction, the drive means is arranged to move at a distance from the complementary drive means without driving the locking tooth.

EP Patent No 2105806 A1 in the name of Girard Perregaux SA discloses a deformable frame defining two orthogonal axes, including a blade spring buckled in its largest dimension and arranged to restore energy when there are changes in the shape of the bistable blade.

EP Patent No 2 221677 A1 in the name of Rolex SA discloses a detent escapement with a lever pivoting against a spring, which pushes a stop element of said lever towards the escape wheel; the lever carries a release element which cooperates with a release finger carried by a roller whose position is moveable relative to the balance roller under the effect of variations in the velocity of the balance.

CH Patent No 60813 A in the name of Shortill discloses a lever escapement whose escape wheel includes, on both sides of the flange thereof, alternating teeth cooperating with pallet-stones mounted opposite to and facing each other.

EP Patent No 1967919 A1 in the name of ETA SA discloses an escapement with tangential impulses comprising a moveable, ring-shaped frame comprising palette stones arranged to cooperate with the teeth of a moveable escapement located inside the ring.

SUMMARY OF THE INVENTION

The invention proposes to overcome the limitations of known architectures, by proposing compact mechanisms having a small thickness and which are economical to produce.

To this end, the invention concerns an escapement mechanism for a timepiece movement or timepiece including at least one balance and at least one escape wheel, characterized in that the transmission of impulses between said at least one balance and said at least one escape wheel is performed by a flexible single-piece mechanism including at least one feeler spindle cooperating with said at least one escape wheel or respectively said at least one balance, and in that said flexible single-piece mechanism is connected by at least one flexible blade to a fixed structure of said timepiece, or respectively to said at least one escape wheel.

The invention also concerns a timepiece movement including a fixed structure and at least one mechanism of this type.

The invention also concerns a timepiece including a fixed structure and at least one mechanism of this type, and/or at least one timepiece movement of this type.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
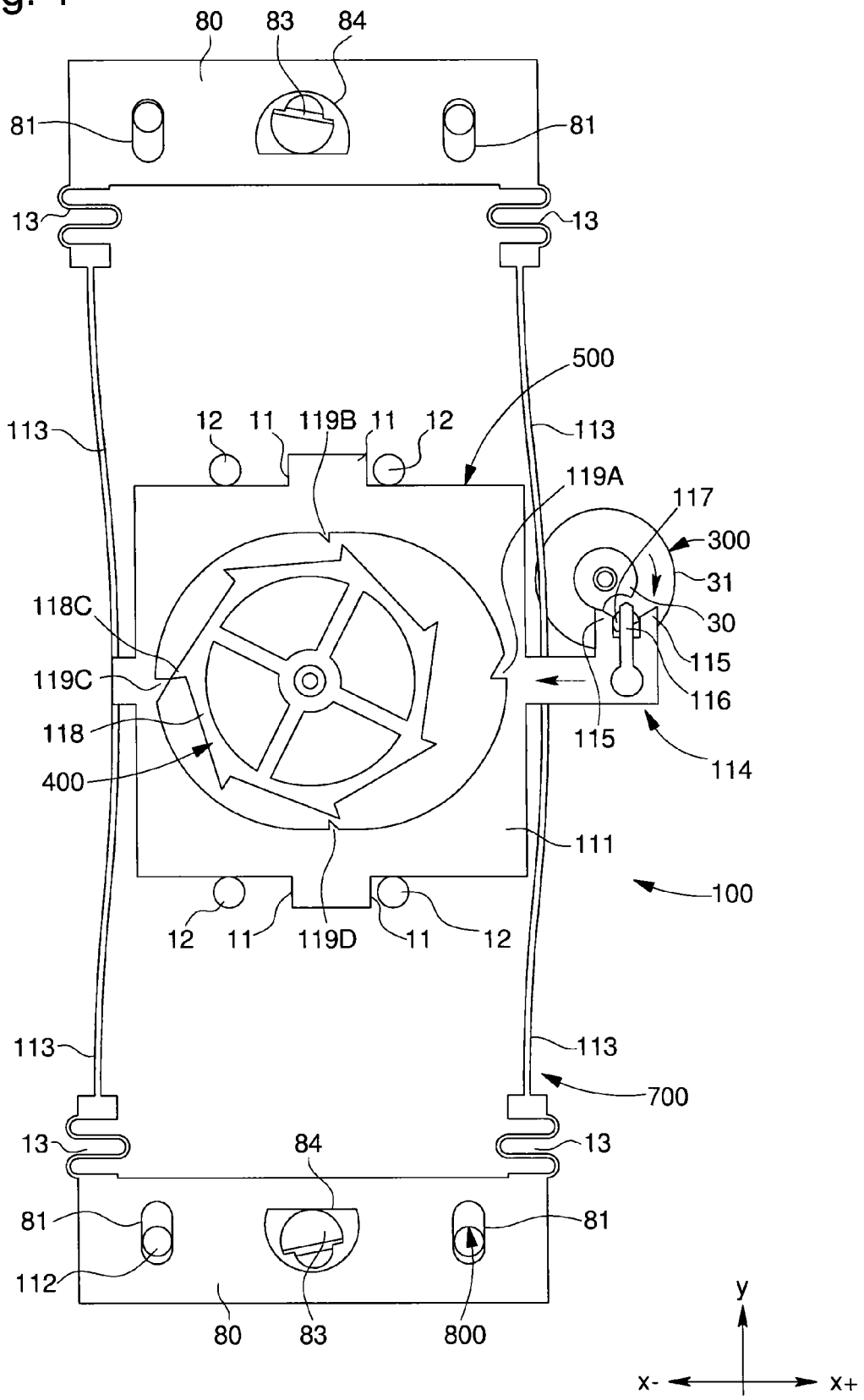
FIGS. 1 to 10 show schematic elevations of the various steps of the kinematics of a particular escapement mechanism variant with a guide member having zero rigidity, which is shown generally in FIG. 11 in another simplified variant.

Numerous timepiece mechanisms may be made, with a reduced number of components, and preferably using components made of silicon, or by a LIGA or DRIE method, comprising flexible areas.

These flexible areas may be used to form guide members, particularly pivot guides, and/or to form elastic return means.

"Flexible guide members" in the following description means linear or rotating guide members comprising one or more flexible blades. These guide members have numerous advantages, of which the following, in particular, may be cited: precision, no friction, no hysteresis, no wear, no requirement for lubrication, no seizing, monolithic manufacturing. The most common limitations are: limitation of movements, low return force or torque density, occasionally complex kinematics, limitation on the load carried.

Flexible guide members may be modified to obtain zero rigidity or to have a bistable state in the case of a component that works by buckling under the action of stresses exerted on both sides of a middle direction, on either side of which the component may occupy two different stable states.

The invention is applicable to an escape mechanism 100 for a timepiece movement 900 or timepiece 1000 including at least one balance 300 and at least one escape wheel 400.

According to the invention, the transmission of impulses between said at least one balance 300 and said at least one escape wheel 400 is achieved via a flexible single-piece mechanism 500. This flexible single-piece mechanism 500 includes at least one feeler spindle 600 cooperating with said at least one escape wheel 400 or respectively said at least one balance 300. Flexible single-piece mechanism 500 is connected by at least one flexible blade 700, or preferably by a plurality of flexible blades forming elastic return means, to a fixed structure 800 of said timepiece 1000, or respectively to said at least one escape wheel 400.

A particular application is illustrated in FIGS. 1 to 11 and concerns an escapement mechanism 100 with a guide member having zero rigidity and substantially paraxial mobility.

Flexible, single-piece mechanism 500 comprised therein is also called a blocking lever It includes a plurality of flexible blades 700, which are prestressed, buckled, flexible blades 113.

This mechanism 100 includes a movable frame 111 hinged by flexible blades 113 with respect to fixed anchoring elements 112. These flexible blades 113 are beams operating in buckling mode.

Flexible blades 113 are extended, in the variant of FIGS. 1 to 10, by springs 13. These springs 13 are integral with weights 80 which are either rigidly fixed to fixed structure 800, or which have a small degree of freedom with respect to structure 800 as in FIGS. 1 to 10 where weights 80 include oblong portions 81, which provide a degree of freedom, over a small, limited travel, with respect to pins 112 comprised in rigid structure 800. This degree of freedom is in a single direction Y, called the ordinate direction.

A cam 83 is provided in a hole 84 in a weight 80, preferably on each side, to perform pre-winding.

Movable frame 111 includes at least one loaded spring giving it zero rigidity.

This movable frame 111 which is the equivalent of a pallet lever, carries a fork 114 with horns 115 and a dart 116. This fork 114 is similar to that of a Swiss lever, with all the anti-knocking and anti-tripping safety devices.

In the application illustrated in the Figures, movable frame 111 completely surrounds escape wheel 400, with which it is coplanar.

Thus, in short, this flexible, single-piece mechanism 500 is a blocking lever which includes at least one movable frame 111 carrying locking beaks 119, which are arranged to cooperate with teeth 118 comprised in escape wheel 400, a plurality of flexible blades 700, which are prestressed, buckled, flexible blades 113, and a fork 114 carrying horns 115 for cooperating with an impulse pin 117 of balance 300.

Figure 11:
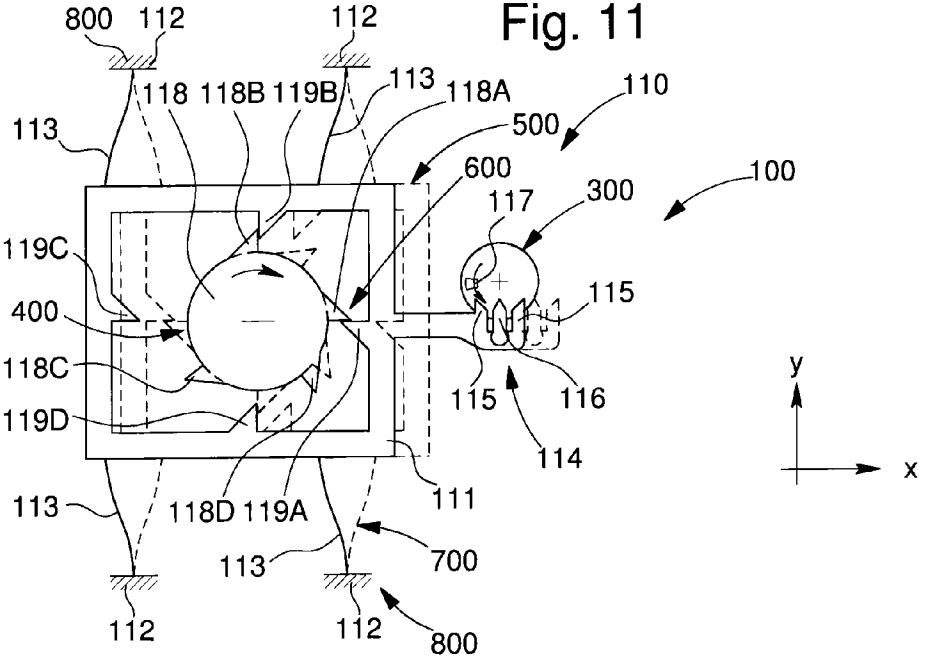
Figure 12:
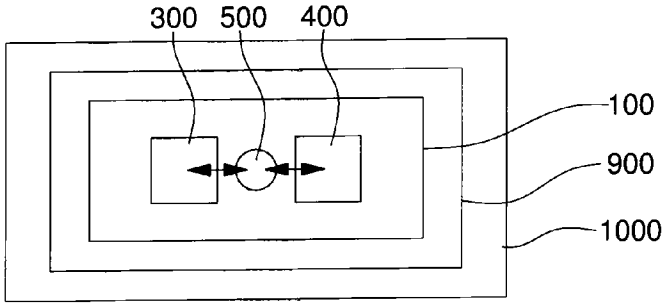
FIG. 12 shows, in the form of block diagrams, a timepiece with a movement including a mechanism of this type.

An escape wheel 400 includes impulse teeth 118A, 118B, etc. arranged at equal angles to each other (60° in FIGS. 1 to 10, 90° in FIG. 11).

Preferably, locking beaks 119 are arranged in opposite pairs. In the embodiment of the Figures, a first pair of beaks 119A, 119C is aligned in a first direction X, called the abscissa direction, in which the fork pin 114 extends and moves; and a second pair of beaks 119B, 119D, extend in a second direction Y, called the ordinate direction, perpendicular to first direction X.

These impulse teeth 118 may cooperate with teeth called locking beaks 119A, 119B, 119C, 119D of movable frame 111, arranged here at 90° to each other.

Balance 300 and small roller 30 and large roller 31 are similar to those of a conventional Swiss lever. This movable frame 111 is preferably movable in a substantially paraxial manner, and essentially moves in direction X. According to the design of the direction, this movable frame 111 can make movements of small amplitude in the ordinate direction Y, within a limit defined by the travel of flexible blades 113 and of springs 13, these Y movements allow abutting engagement or, conversely, release of stop members.

In the particular version of FIGS. 1 to 10, movable frame 111 has stop faces 11, in direction X, which cooperate or do not cooperate, depending on the position of movable frame 111, with limit stop members 12.

In short, blocking lever 500 includes at least one movable frame 111, flexible blades 113 and fork 114 carrying horns 115.

The kinematics of the mechanism of FIG. 11 is as follows:

When impulse pin 117 enters into contact with horn 115, a locking beak 119A of movable frame 111 releases escape wheel 400 without recoil, and tooth 118B of escape wheel 400, substantially square with locking beak 119A, imparts a tangential impulse on movable frame 11 of the pallet lever on a locking beak 119B. At the end of the impulse, tooth 118C of the escape wheel is stopped by the corresponding tooth 119C on the pallet lever. The impulse cycle is repeated in a similar manner with teeth 118D and 119D.

More load on flexible blades 113 can create a bistable system. The position of impulse tooth 118B with respect to locking beak 119A may bring the pallet lever close to instability. As a result, pallet lever 111 supplies an impulse via escape wheel 400 and the energy stored in flexible blades 113.

The system has all the safety devices of a Swiss lever escapement.

For the variant of FIGS. 1 to 10, the kinematics are as follows:

FIG. 1: unlocking. The balance pivots in the clockwise direction. Tooth 118C which was meshed with locking beak 119C starts to release itself from said beak, during the movement of translation towards the left, along X− in the Figure, of movable frame 111. At the start of unlocking, the frame is close to the end of its travel along X+.

Figure 2:
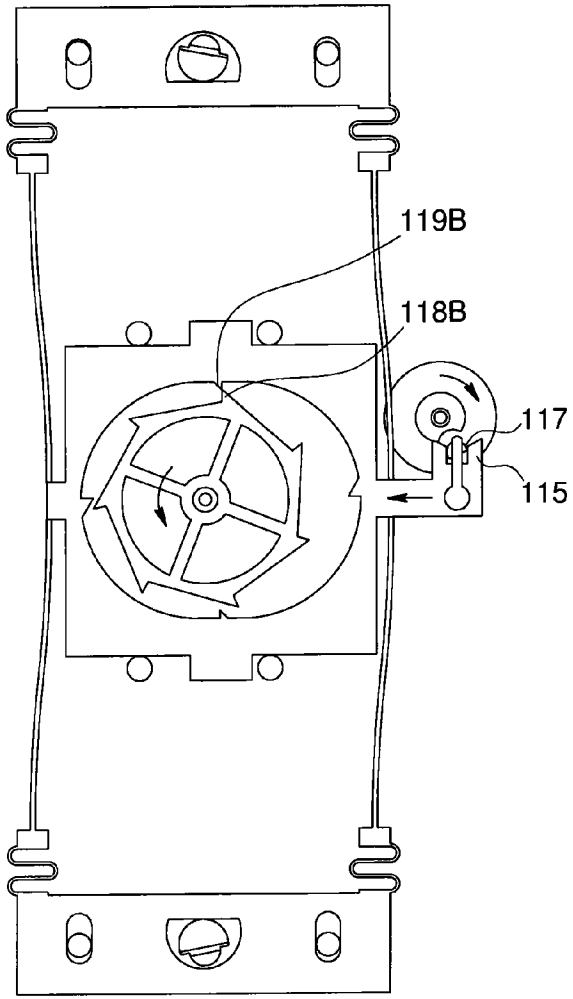

FIG. 2: start of the impulse. Tooth 118C is completely released, escape wheel 400 pivots, horn 115 gives the impulse to impulse pin 117, the movable frame is returned along X− under the effect of the impulse given by tooth 118B to beak 119B.

Figure 3:
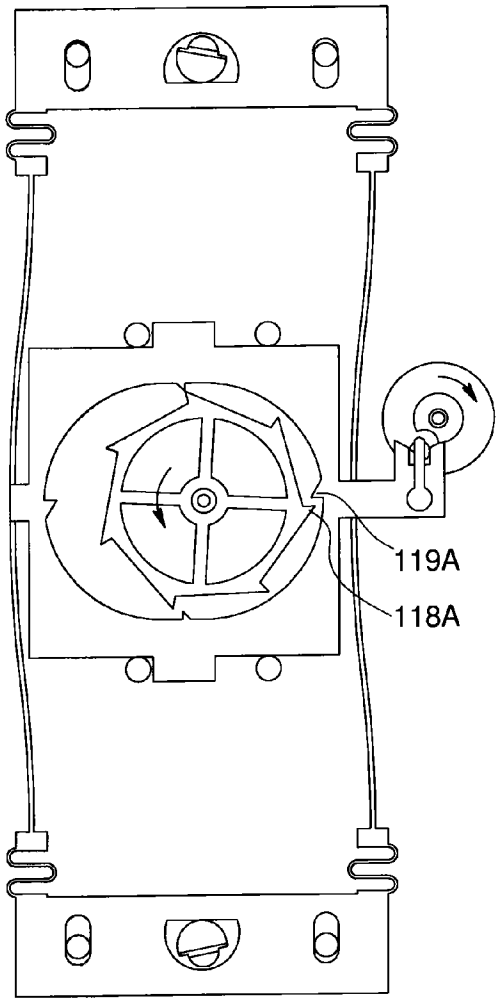

FIG. 3: end of the impulse. Bistable blades 113 have just passed their bistable position. Movable frame 111 has completed its travel at X−, under the effect of the elastic return of blades 113 and is at the end of travel along X−.

Figure 4:
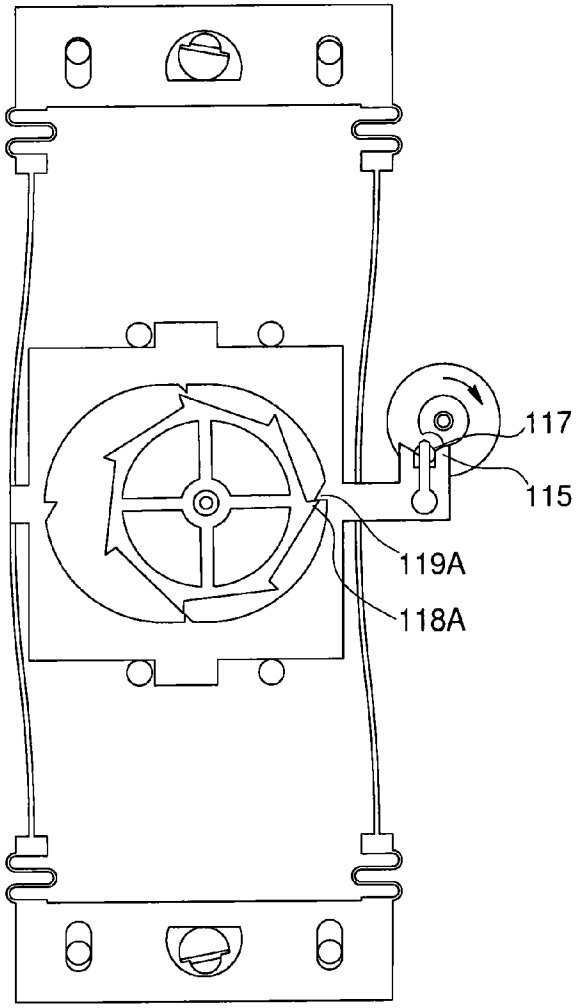

FIG. 4: locking engagement. Tooth 118A meshes on locking beak 119A.

Figure 5:
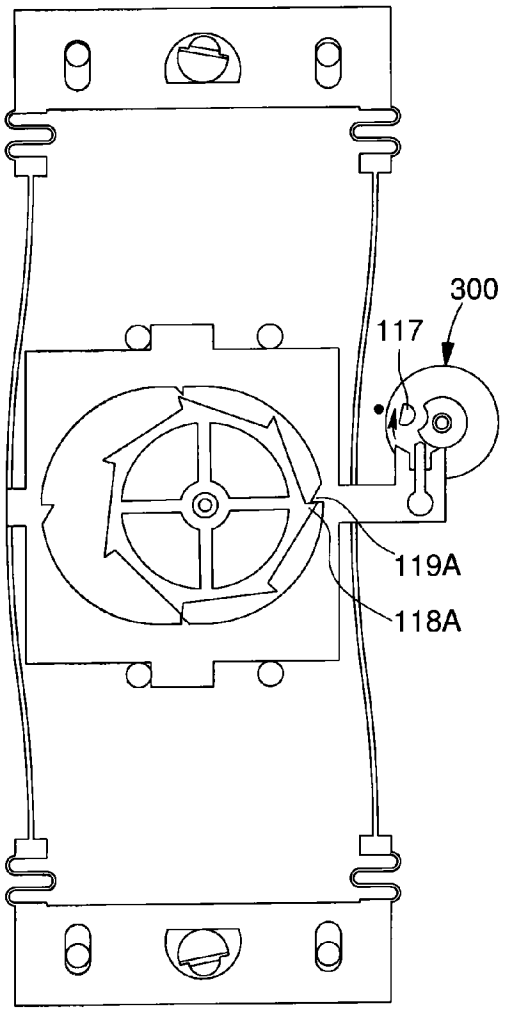

FIG. 5: total lock. Tooth 118A is locked on locking beak 119A. Balance 300 describes the supplementary arc and reaches its inversion point.

Figure 6:
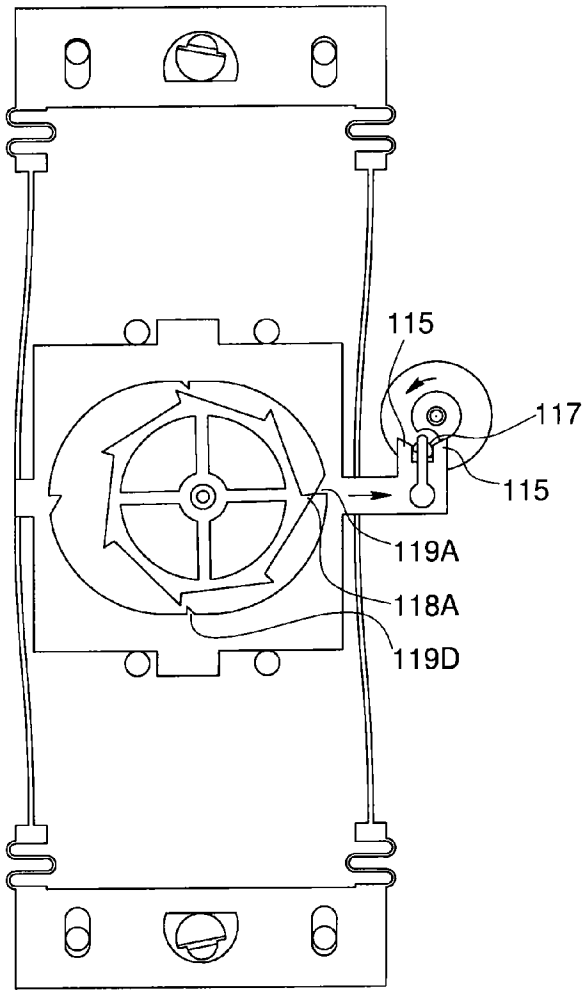

FIG. 6: unlocking. Balance 300 pivots in the anti-clockwise direction. Pin 117 returns to cooperate with horns 115, to move movable frame 111 far enough along X+ to release tooth 118A from beak 119A.

Figure 7:
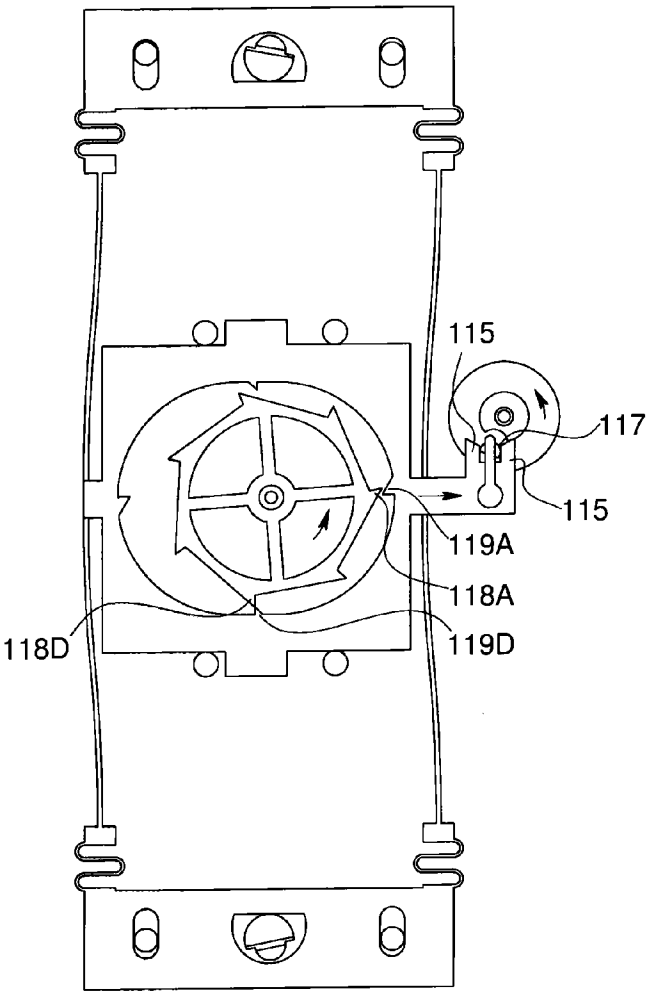

FIG. 7: start of the impulse. Tooth 118A is released from beak 119A. Wheel 118 pivots. Movable frame 111 continues its travel along X+, as a result of the driving of beak 119D by tooth 118D.

Figure 8:
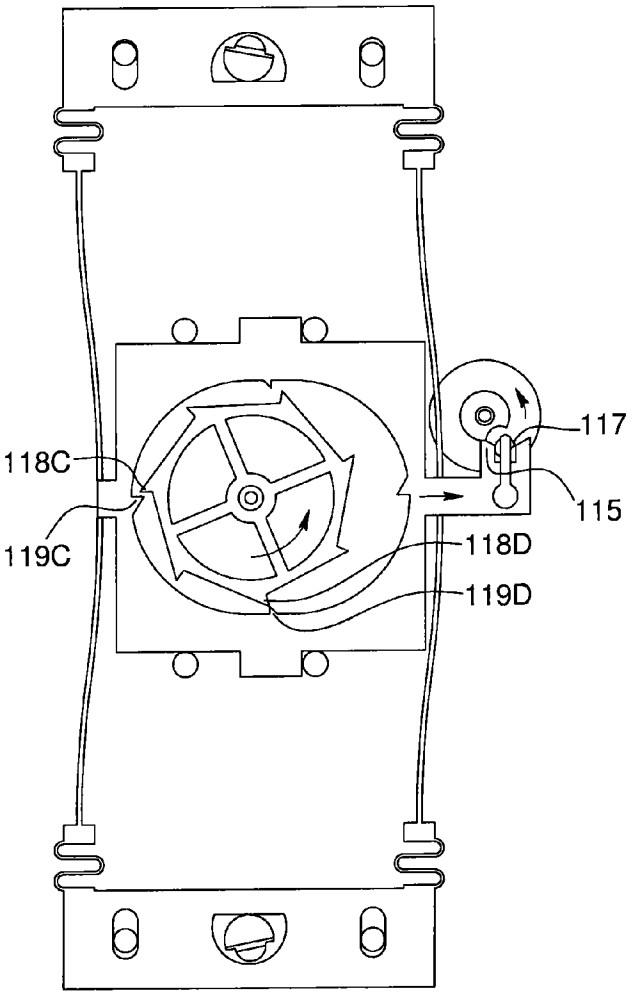

FIG. 8: end of the impulse. Bistable blades 113 have just passed their bistable position. Movable blade 111 has completed its travel along X+, and is at the end of travel along X+. Tooth 118C approaches locking beak 119C.

Figure 9:
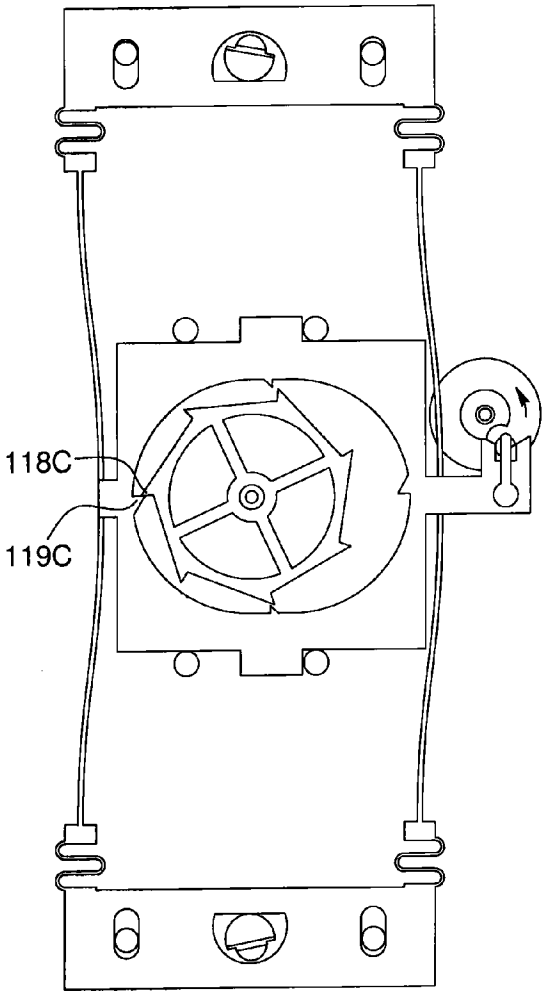

FIG. 9: locking engagement. Tooth 118C is bearing on locking beak 119C.

Figure 10:
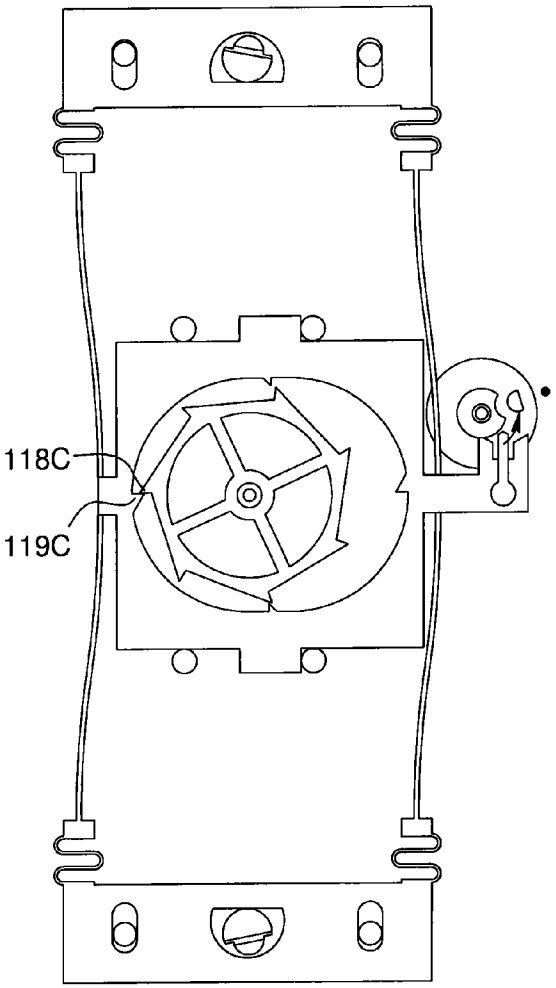

FIG. 10: total lock. Tooth 118C is locked on locking beak 119C. Balance 300 describes the supplementary arc and reaches its inversion point.

the cycle continues as in FIG. 1, but, of course, with other escape wheel teeth.

Advantageously, in this variant of FIGS. 1 to 10, the force given by loaded springs 12 is 10 to 15% greater than the maximum buckling force of flexible blades 113, in order to ensure the positioning of frame 111, by its stop faces 11, against limit stop members 12.

The force of these loaded springs also has an upper limit, to ensure self-starting, and this limit is a function of the inertia of the balance.

The locking mechanism is shown here with one level. It is also possible to make the mechanism on several levels, in particular with each of the beaks (impulse and locking) on a different level.

In a particular embodiment example, for a balance oscillating at 4 Hz, and a silicon locking mechanism 500 of this type, in a wafer 0.15 mm high, with a locking lever travel of +/−0.35 mm, and total lock of 0.05 mm, proper operation, which also ensures self-starting, is obtained with the following different configurations:

balance inertia of 4 mg·cm2; flexible blade length 5.0 mm; blade thickness 0.02 mm, critical buckling force 5.8 mN, spring load 6.9 mN;

balance inertia of 9 mg·cm2; flexible blade length 5.0 mm; blade thickness 0.02 mm, critical buckling force 5.8 mN, spring load 6.9 mN;

balance inertia of 9 mg·cm2; flexible blade length 5.0 mm; blade thickness 0.02 mm, critical buckling force 5.8 mN, spring load 7.2 mN;

balance inertia of 4 mg·cm2; flexible blade length 1.7 mm; blade thickness 0.01 mm, critical buckling force 6.2 mN, spring load 7.2 mN;

The invention also concerns a timepiece movement 900 including at least one flexible mechanism of this type, and in particular including a fixed structure 800 and at least one mechanism 100 of this type.

The invention also concerns a timepiece 1000, in particular a watch, including at least one timepiece movement 900 of this type, and/or at least one flexible mechanism of this type, in particular including a fixed structure 800 and at least one mechanism 100 of this type.

The invention claimed is:

1. An escapement mechanism for a timepiece movement or timepiece including at least one balance and at least one escape wheel, wherein transmission of impulses between the at least one balance and the at least one escape wheel is performed by a single-piece, flexible mechanism, comprised in the escapement mechanism and including at least one feeler-spindle cooperating with the at least one escape wheel or respectively the at least one balance; and wherein the single-piece, flexible mechanism is connected by at least one flexible blade comprised therein to a fixed structure of the timepiece or respectively to the at least one escape wheel;

wherein the single-piece, flexible mechanism is a locking lever that includes at least one movable frame carrying locking beaks configured to cooperate with teeth comprised in the escape wheel, a plurality of the flexible blades which are flexible, prestressed buckled blades, and a fork carrying horns for cooperating with an impulse pin of the balance, and wherein the movable frame completely surrounds the escape wheel;

wherein the flexible blades are extended by springs that are integral with weights which are either rigidly fixed to the fixed structure, or which have a small degree of freedom with respect to the structure limited by oblong portions cooperating with pins comprised in the rigid structure, in an orthogonal direction to a direction of translation, as an abscissa direction, of the movable frame.

2. The mechanism according to claim 1, wherein the movable frame forms a pallet lever movable in translation in the direction of translation and includes at least one loaded spring giving the frame zero rigidity, the mechanism configured so that, when the pin enters into contact with an entry horn, one the locking beaks of the movable frame releases the escape wheel without recoil, and a tooth of the escape wheel in a position substantially perpendicular to the tooth imparts a tangential impulse on the movable frame, and, at an end of the impulse, a tooth of the escape wheel is stopped by a corresponding tooth of the movable frame.

3. The mechanism according to claim 1, wherein a load of the flexible blades is calculated to create a bistable system, and a position of the impulse tooth, with respect to the locking beak, can bring the movable frame close to instability, to allow the frame to provide an impulse via the escape wheel and energy stored in the flexible blades.

4. The mechanism according to claim 1, wherein the flexible blades are extended by springs, that are integral with weights that are either rigidly fixed to the fixed structure, or which have a small degree of freedom with respect to the structure limited by oblong portions cooperating with pins comprised in the rigid structure, in an orthogonal direction to the direction of translation of the movable frame.

5. The mechanism according to claim 1, including at least one cam in a hole in the weight, the cam configured to perform pre-winding of the flexible blades.

6. The mechanism according to claim 1, wherein the movable frame includes stop faces in a direction of translation of the frame, configured to cooperate in end-of-travel abutment with limit stop members.

7. The mechanism according to claim 4, wherein the movable frame includes stop faces in the direction of translation of the frame, configured to cooperate in end-of-travel abutment with limit stop members, and wherein force given by the at least one loaded spring is 10% to 15% greater than a maximum buckling force of the flexible blades, to ensure positioning of the movable frame, by the stop faces thereof, against the limit stop members.

8. The mechanism according to claim 1, wherein the locking beaks are arranged in opposite pairs.

9. The mechanism according to claim 8, wherein a first pair of locking beaks is aligned in the first abscissa direction in which the fork pin extends and moves, and a second pair of locking beaks extend in a second direction perpendicular to the first abscissa direction.

10. A timepiece movement comprising a fixed structure and at least one mechanism according to claim 1.

11. A timepiece including a fixed structure and at least one mechanism according to claim 1.

12. A timepiece including a fixed structure and at least one timepiece movement according to claim 10.

* * * * *